United States Patent [19]

DiVito

[11] 3,995,650

[45] Dec. 7, 1976

[54] ADJUSTABLE POSITIONED HANDGRIP FOR CANES, CRUTCHES, WALKERS AND OTHER AMBULATORY AIDS

[75] Inventor: Fred DiVito, Bronx, N.Y.

[73] Assignee: Lumex, Inc., Bay Shore, N.Y.

[22] Filed: Sept. 10, 1975

[21] Appl. No.: 611,999

[52] U.S. Cl. ..... 135/72; 74/551.9; 273/81 C; 403/4

[51] Int. Cl.[2] ..... A61H 3/02

[58] Field of Search ..... 135/51, 72; 273/81 R, 273/81 B, 81 C, 81 D; 16/110 R, 118, 121, DIG. 23; 74/555.8, 555.9; D88/4; 403/4

[56] References Cited

UNITED STATES PATENTS

| | | | |
|---|---|---|---|
| 626,633 | 6/1899 | Robinson | 74/551.9 |
| 1,258,647 | 3/1918 | Bowers | 74/551.9 |
| 1,580,724 | 4/1926 | Harmon | 74/551.9 |
| 2,197,279 | 4/1940 | Thorssen | 135/51 |
| 2,409,365 | 10/1946 | Lamb | 135/51 |
| 2,736,330 | 2/1956 | Wood | 135/51 |
| 3,122,774 | 3/1964 | Lamb | 16/110 R |
| 3,174,494 | 3/1965 | Maguire, Jr. | 135/51 |
| 3,269,399 | 8/1966 | Smith | 135/51 |

*Primary Examiner*—Werner H. Schroeder
*Assistant Examiner*—Conrad L. Berman
*Attorney, Agent, or Firm*—Edward H. Loveman

[57] ABSTRACT

An adjustably positioned handgrip assembly for an ambulatory aid includes an elongated rigid body having an axial cylindrical bore for receiving a cylindrical tube end of the ambulatory aid. The body has an oval portion of maximum size at one end tapering gradually to a plane of minimum oval cross section near the other end, then gradually becoming circular to terminate in a circular portion at the other end. A plug insert which fits into the tube end of the ambulatory aid has notches selectively engageable with lugs in the cylindrical bore of the body for securing the body in any one of a plurality of angular positions on the tube end of the ambulatory aid. An axial bore attaches the body of the handgrip assembly to the ambulatory aid.

8 Claims, 23 Drawing Figures

ADJUSTABLE POSITIONED HANDGRIP FOR CANES, CRUTCHES, WALKERS AND OTHER AMBULATORY AIDS

This invention concerns a new handgrip for canes, crutches, walkers and other aids to patient ambulation and more particularly concerns an adjustably positioned handgrip for ambulatory aids. Conventional handgrips have limited weight-bearing characteristics. Generally they are cylindrical or round which causes discomfort and lack of control in ambulation.

According to the present invention there is provided an improved handgrip which takes into account the requirements of muscular statics and dynamics. The handgrip is specially shaped to provide the necessary area of hand contact and hence weight-bearing surface for the user. The handgrip is contoured to prevent the user's hand from slipping out of position, and it is rigid for greater control and stability. It is more comfortable because it is shaped to conform to the shape of the hand while weight-supporting, and it is sized to accomodate most hands. The handgrip is tapered to conform to anatomical characteristics of the hand while weight-bearing, and to take advantage of the actual dynamics of the hand and arm muscles involved in gripping. The handgrip may be rotated and locked in any one of a plurality of positions to enable the user to achieve the most natural wrist position, and offering the least possibility of fatigue. The handgrip is shaped so that it may be used by the right or the left hand.

It is therefore a principal object of the present invention to provide a handgrip for a crutch, cane, walker or other ambulation aid, which is oval in cross section in areas where the hand is contacted to provide broader weight-bearing surfaces and to eliminate uncomfortable high pressure areas.

A further object of the present invention is to provide a handgrip as described which is contoured to conform to the natural shape of the hand while weight-bearing.

Another object of the present invention is to provide a handgrip which is tapered to accomodate most hand sizes, and shaped to prevent slippage.

Another object of the present invention is to provide a handgrip as described, which is shaped to afford greater comfort in use, to permit repositioning of the hand to help reduce possibility of cramping, and to provide greater stability and control.

Still another object of the present invention is to provide a handgrip as described which may be rotated and fixed in any one of a plurality of positions to permit optimum wrist position for either right or left hand.

Yet another object of the present invention is to provide a handgrip as described with an adapter for mounting on an existing handle or handgrip of a cane, crutch, walker or the like.

These and other objects and many of the attendant advantages of this invention will be readily appreciated as the same becomes better understood by reference to the following detailed description when considered in connection with the accompanying drawings in which.

Figure 2:
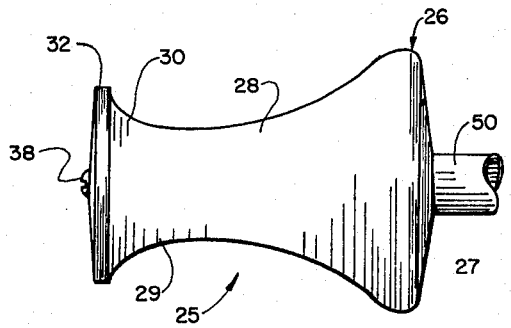
FIG. 2 is a top plan view of the handgrip assembly and the tube end of a cane or walker.
Figure 3:
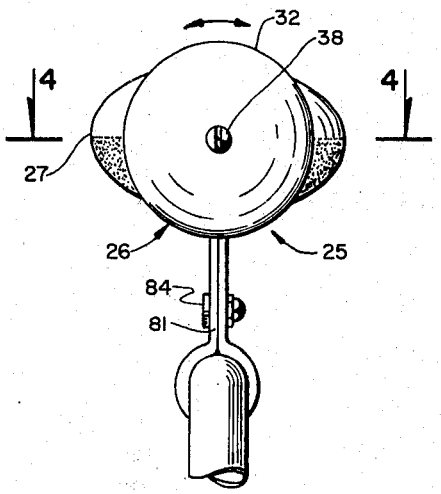
FIG. 3 is an end view of the handgrip assembly taken along line 3—3 of FIG. 1.
Figure 1:
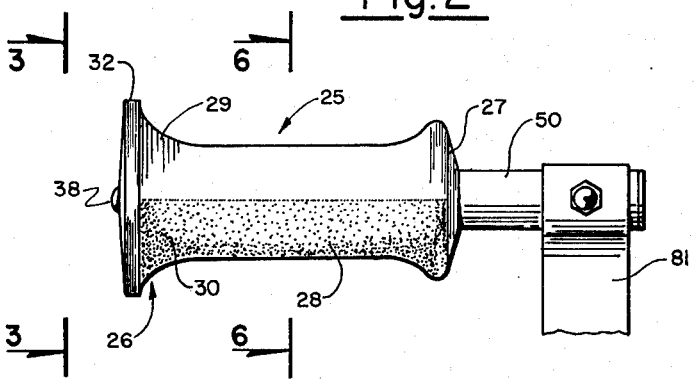
FIG. 1 is a side view of a handgrip assembly embodying the invention, shown mounted on the tube end of a cane or walker.
Figure 4:
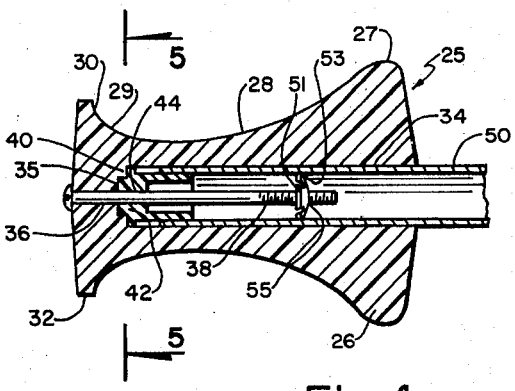
FIG. 4 is a central sectional view taken along line 4—4 of FIG. 3.
Figure 5:
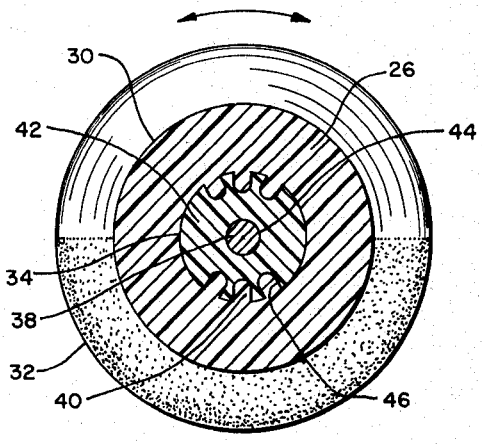
FIG. 5 is an enlarged cross sectional view taken along line 5—5 of FIG. 4.
Figure 7:
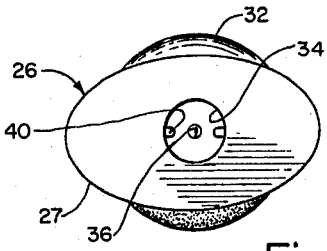
FIG. 7 is an enlarged end view of the handgrip per se.
Figure 6:
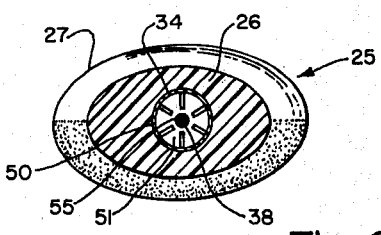
FIG. 6 is an enlarged cross sectional view taken along line 6—6 of FIG. 1.
Figure 8:
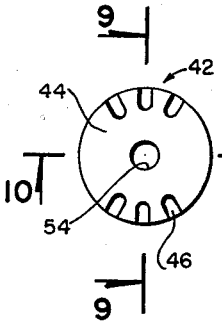
FIG. 8 is an end view of a plug insert employed in the handgrip assembly for adjustably positioning the handgrip on the pipe end of the cane or crutch.
Figure 9:
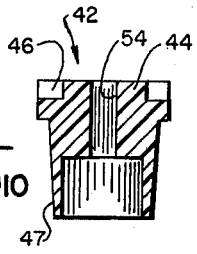
FIG. 9 and FIG. 10 are axial sectional views taken 90° apart on lines 9—9and 10—10 respectively of FIG. 8.
Figure 10:
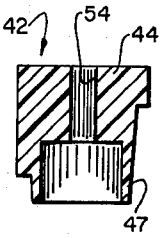
Figure 11:
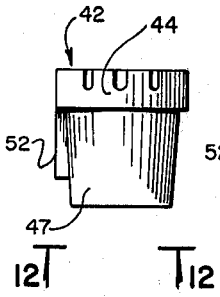
FIG. 11 is a side view of the plug insert.
Figure 12:
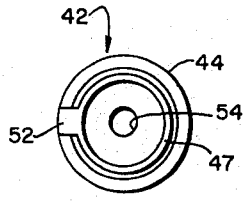
FIG. 12 is an end view of the plug insert taken along line 12—12 of FIG. 11.
Figure 13:
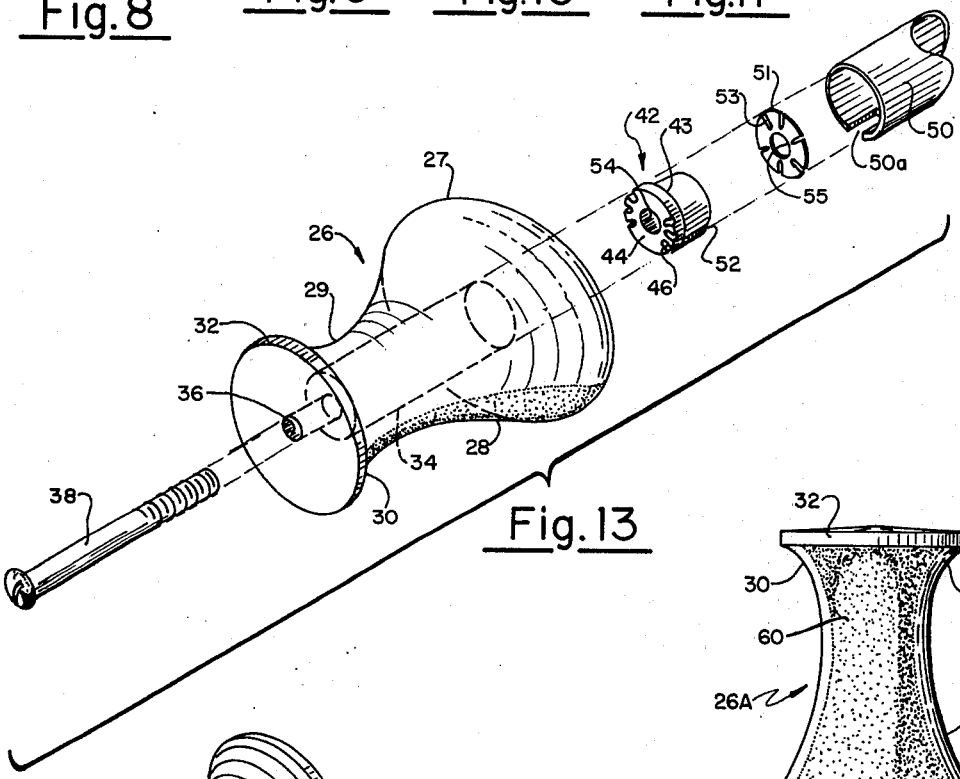
FIG. 13 is an exploded perspective view of parts of the handgrip assembly and tube end of the cane or walker.

Referring now to the drawings wherein like reference characters designate like or corresponding parts throughout, there is illustrated in FIGS. 1–5, a handgrip assembly generally designated by reference numeral 25 including a hangrip body generally designated by reference numeral 26 which has a wide and portion 27, oval when viewed in cross section, as best illustrated in FIGS. 4, 6 and 7. An adjacent intermediate portion 28 is oval when viewed in cross section but of gradually tapering shape until a plane 29 of a minimum cross section. Then an intermediate transition section 30 of the handgrip body 25 gradually assumes a circular shape when viewed until the outer end section 32 is reached where the handgrip is circular in cross section.

The handgrip body 26 is formed with an axial cylindrical bore 34 extending inwardly from the wider end 27 and terminating in a blind end 35 which is spaced from the circular end section 32; see FIGS. 4–7. A central bore 36 is formed in the circular and transition end sections 30, 32 to receive an anchoring bolt 38. At the blind end of the bore 34 are two diametrically opposed integral lugs 40 extending radially inward; see FIGS. 5 and 7. These lugs may be adjustably engaged into a plug insert 42 as best shown in FIGS. 4, 5 and 8–13.

The plug insert 42 has a generally cylindrical body 44 formed with two sets of three notches 46 in one end. The notches 46 in each set are circumferentially spaced apart; see FIG. 8. The two sets of notches 46 are in diametrically opposite positions. An outer body portion 47 of the insert is tapered to fit within a cylindrical tube end 50 of a cane or walker or the like. A shoulder stop 43 of the cylindrical body 44 serves as an abutment for the tube end 50. A land 52 on the outside of the body 44 is located between the two sets of notches 46 and serves as an index for the position of the notches 46. The land 52 fits into a slot 50*a* of the tube end 50. A central hole 54 in the body 44 receives the bolt 38 which is threaded into a central hole of a bell type washer 51 which has radial teeth 53 to engage and lock in the tube end 50. To assemble the handgrip assembly 25, the plug insert 42 is first inserted into the free end of the tube end 50 up to the circular protruding end stop 50*a*. The handgrip 26 may be rotated to any one of three positions by aligning the lugs 40 with a pair of diametrically opposite notches 46 and then the handgrip 26 is pressed axially inward to engage the lugs and aligned notches. As viewed in FIG. 5, it will be seen that the lugs 40 are engaged in the center notches 46. However, the handgrip 26 can be rotated clockwise before engagement with the plug insert 42 to engage the upper left and lower right notches 46 of the insert 42 with the lugs 40 of the handgrip 26 or the handgrip 26 can be rotated counterclockwise to engage the upper right and lower left notches 46 with the lugs 40. The handgrip 26 may be rotated in one direction or the other depending on whether the right hand or left hand of the user is intended to grasp the handgrip 26. If either hand is to be used, then it may be best to engage lugs 40 of the handgrip 26 with the center notches 46 of the insert 42, as best shown in FIG. 5. It will be noted that the handgrip 26 is locked in position when the lugs and notches are engaged. The broader faces of the handgrip body are contacted by the user's hand H; see FIG. 22. This insures maximum comfort and efficiency in weight-bearing. The contoured shape conforms to the shape of the hand. The tapered shape prevents hand slippage. The bolt 38 is engaged in the center hole 55 of the washer 51. The bolt may be tightened by a screwdriver engaged with the slotted hand of the bolt at circular section 32. This locks the handgrip and tube end securely together.

Figure 14:
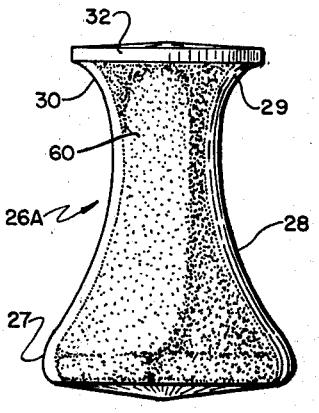
FIG. 14 is a top plan view of a modified hand grip.
Figure 15:
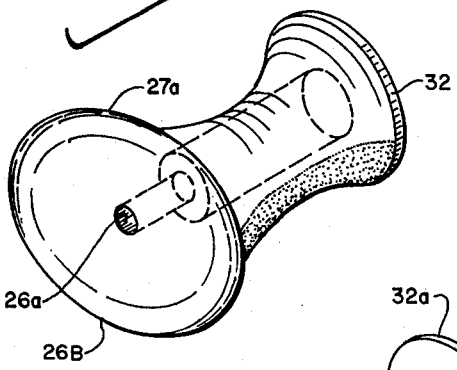
FIG. 15 and FIG. 16 are perspective views taken 180° apart of another handgrip embodying the invention.
Figure 16:
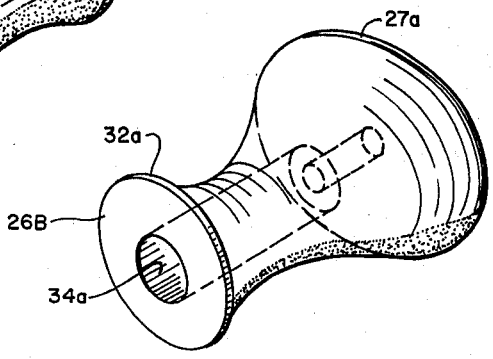
Figure 17:
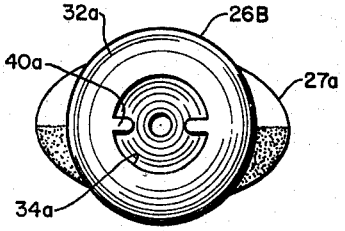
FIG. 17 is an enlarged end view of the handgrip of FIGS. 15 and 16.
Figure 18:
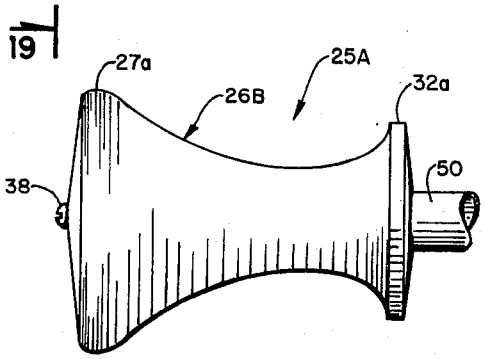
FIG. 18 is a top plan view of another handgrip assembly employing the handgrip of FIGS. 15–17.
Figure 20:
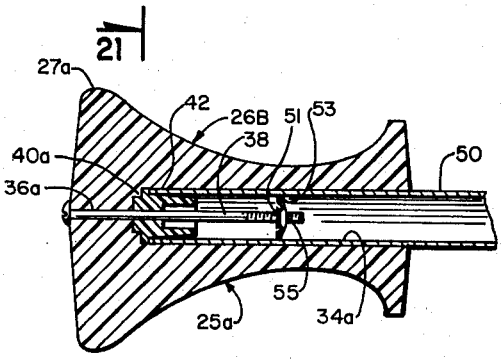
FIG. 20 is a reduced axial sectional view taken along line 20—20 of FIG. 19.
Figure 19:
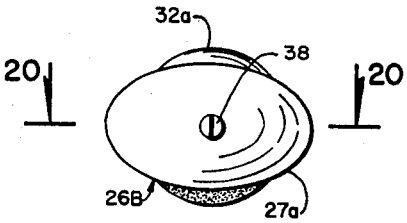
FIG. 19 is an enlarged end view of the handgrip taken along line 19—19 of FIG. 18.

FIG. 14 shows another handgrip 26A which is identical to handgrip 26 except that one or both sides are formed with roughened or pebbled surfaces 60 to improve the frictional grip on the handgrip body.

FIGS. 15–21 show another handgrip body 26B which is similar in shape to the handgrip body 26, and forming part of another handgrip assembly 25A. The bore 34*a* extends inwardly from a circular end 32*a* of the handgrip body 26B and terminates short of a widest oval end 27*a*. A hole or bore 36*a* which receives the bolt 38 is formed in the outer, wider oval end of the handgrip 26B. Two lugs 40*a* engage the mating notches 46 of the plug insert 42 in the same manner as described above. The tube end 50 engages in the blind bore 34*a* and is secured in place by the bolt 38 engaging the washer 51 anchored in the tube end. The reversed arrangement of the bores in the handgrip body 26A enables the handgrip to be mounted on the tube end 50 in a position reversed from that of FIGS. 1–6. This construction is employed for applications on certain walkers and crutches where it will be most comfortably grasped. This is especially so when the tube end 50 extends rearwardly of the user's hand rather than forwardly.

Figure 23:
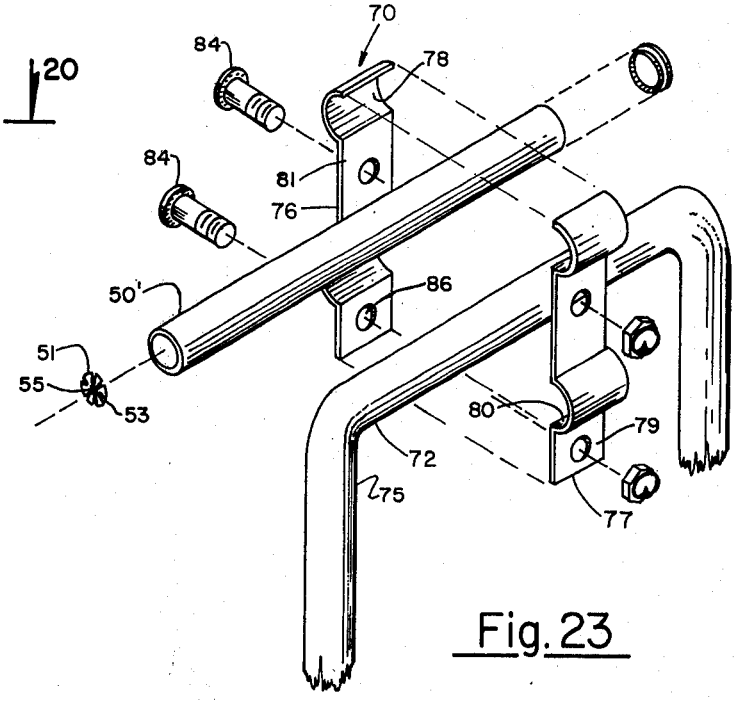
FIG. 23 is an exploded perspective view of parts of the adapter and assembly of FIG. 22.
Figure 22:
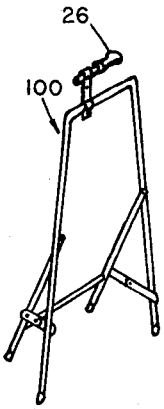
FIG. 22 is a perspective view of a handgrip assembly and adapter for mounting on the handle of a walker.
Figure 21:
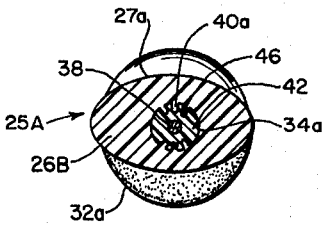
FIG. 21 is an enlarged cross sectional view taken along line 21—21 of FIG. 20.

FIG. 22 shows an assembly 100 including the handgrip 26 provided with an adapter 70 for mounting on a cylindrical handle 72 of an ambulation aid 75. The adapter 70 shown in FIG. 22 and FIG. 23 includes a pair of flanged clamp plates 76, 77 having mating semi-cylindrical recesses 78 and 80. Recesses 78 receive a short cylindrical tube 50′ whose diameter is the same as bore 34. Larger recesses 80 receive handle 72. Screws 84 extend through holes 86 in flat flange 79 of plate 76 and engage in threaded holes 88 in flat flange 81 of plate 77. By this arrangement, any one of the handgrips 26, 26A or 26B can be provided with adapter 70 for mounting on a handle or tube end of larger diameter than bore 34 or 34*a* in the handgrip body. Washer 51 with teeth 53 is insertable in tube 50′ and locks therein when once inserted. Threaded hole 55 receives and engages bolt 38 as shown in FIG. 4.

The handgrip and plug inserts are all preferably molded of strong, rigid, durable plastic material. They are light in weight, relatively inexpensive to manufacture and long lasting. The handgrip fits large, medium and small hands, providing more comfortable weight-bearing and is safer in use than prior handgrips.

It should be understood that the foregoing relates to only a limited number of preferred embodiments of the invention, which have been by way of example only, and that it is intended to cover all changes and modifications of the examples of the invention herein chosen for the purposes of the disclosure, which do not constitute departures from the spirit and scope of the invention.

The invention claimed is:

1. A handgrip assembly for an ambulatory aid, comprising:

an elongated rigid body adapted for grasping by a user's hand, said body having an axial cylindrical bore for receiving a cylindrical tube end of said ambulatory aid, said body having an oval portion of maximum size at one end and tapering gradually to a plane of minimum oval cross section near its other end, then gradually becoming circular to terminate in a circular portion at said other end;

attachment means for securing together said body on said tube end so that said body is axially immovable on said tube end; and locking means for holding said body on said tube end in mutually nonrotational relationship, whereby said body presents two opposing broad sides for grasping by said user's hand; said locking means comprising:

radial protruding tube means in said tube end; and radial rigid formation means in said cylindrical bore of said body arranged to mate and engage said radial protruding tube means to hold said body in a selected one of a plurality of angularly rotatable positions on said tube end.

2. A handgrip assembly as defined in claim 1, wherein said body has a narrow bore communicating with and axially alinged with said cylindrical bore, said attachment means comprising a bolt engaged in said narrow bore and extending through said cylindrical bore into said tube end; and a member secured in said tube end and arranged to hold said bolt in secured threaded engagement.

3. A handgrip assembly as defined in claim 2, wherein said radial protruding tube means further comprises a plug insert having at least two circumferentially spaced radial protrusions forming a notch thereinbetween which is arranged to engage said formations in said cylindrical bore, said insert having an indexing means arranged to engage into said tube end.

4. A handgrip assembly as defined in claim 1, wherein said cylindrical bore extends inwardly from the circular other end of said body for mounting on said tube end which extends forwardly of said user's hand.

5. A handgrip assembly as defined in claim 1, wherein said cylindrical bore extends inwardly from said one end of maximum size and oval cross section for mounting on said tube end which extends rearwardly of said user's hand.

6. A handgrip assembly as defined in claim 1, wherein at least one broad side of said body is roughened in part to prevent slippage of said user's hand while grasping said body.

7. A handgrip assembly as defined in claim 1, further comprising an adapter for coupling said body to a handle of an ambulatory aid, said adapter comprising clamping means securable on said handle, and a tube member insertable in said cylindrical bore of said body for engagement by said attachment means and insertion of said locking means.

8. A handgrip assembly as defined in claim 7, wherein said clamping means comprises two clamp plates having recesses arranged to receive said handle and said tube member at opposite ends to form a unitary rigid assembly with said body when the same is locked to said tube members and said clamp plates are secured together.

* * * * *